United States Patent [19]

Kocher et al.

[11] Patent Number: 4,507,064

[45] Date of Patent: Mar. 26, 1985

[54] ROTARY GAS COMPRESSOR HAVING ROLLING PISTONS

[75] Inventors: Erich J. Kocher; Paul G. Szymaszek, both of Milwaukee; John G. Nikolaus, West Allis, all of Wis.

[73] Assignee: Vilter Manufacturing Corporation, Milwaukee, Wis.

[21] Appl. No.: 384,027

[22] Filed: Jun. 1, 1982

[51] Int. Cl.[3] ..... F04C 18/00; F04C 29/02; F16K 15/02

[52] U.S. Cl. ..... 418/15; 418/60; 418/63; 418/92; 137/539

[58] Field of Search ..... 418/63, 60, 15, 91, 418/92, 144, 99, 82, 243, 246, 211–215; 137/539, 540; 417/DIG. 1

[56] References Cited

U.S. PATENT DOCUMENTS

| | | | |
|---|---|---|---|
| Re. 24,440 | 3/1958 | Groen | 417/DIG. 1 |
| 333,994 | 1/1886 | Chichester . | |
| 601,916 | 4/1898 | Triplett . | |
| 693,950 | 2/1902 | Cooley . | |
| 899,040 | 9/1908 | Gill . | |
| 992,582 | 5/1911 | Olson . | |
| 1,053,767 | 2/1913 | Allan . | |
| 1,083,710 | 1/1914 | Troutman . | |
| 1,216,378 | 2/1917 | Thomas . | |
| 1,320,531 | 11/1919 | Carroll . | |
| 1,649,256 | 11/1927 | Roessler . | |

(List continued on next page.)

FOREIGN PATENT DOCUMENTS

| | | | |
|---|---|---|---|
| 861849 | 1/1953 | Fed. Rep. of Germany | 418/63 |
| 2254185 | 5/1974 | Fed. Rep. of Germany | 418/15 |
| 2358932 | 5/1975 | Fed. Rep. of Germany | 418/63 |
| 1091637 | 4/1955 | France | 418/93 |
| 1357088 | 2/1964 | France | 418/93 |
| 355457 | 8/1931 | United Kingdom | 418/93 |
| 406030 | 11/1972 | U.S.S.R. | 418/60 |
| 300662 | 1/1973 | U.S.S.R. | 418/63 |

*Primary Examiner*—Richard E. Gluck
*Assistant Examiner*—T. Olds
*Attorney, Agent, or Firm*—James E. Nilles; Thomas F. Kirby

[57] ABSTRACT

A multi-cylinder single-stage rotary rolling piston type gas compressor comprises four modular cylinder housings, partitions and end covers bolted together in end-to-end arrangement. Each cylinder housing includes an inner wall which defines a centrally located cylinder chamber and vane slot and an outer wall which defines a suction chamber, a discharge chamber and an oil chamber or reservoir surrounding the cylinder chamber. The four suction chambers are connected together end-to-end to a common gas inlet port. The four discharge chambers are connected together end-to-end to a common gas discharge port. The four oil chambers are connected together end-to-end. An internally lubricated rotor assembly extends axially through the four cylinder chambers and comprises a shaft rotatably supported on the end covers. The shaft has four eccentric crankarms on which four roller pistons are rotatably mounted, one for each cylinder chamber. The two central pistons are angularly displaced 180° from the two end pistons to provide balance. The rotor shaft drives an oil pump connection to the oil reservoir. Each vane slot for a cylinder chamber has at least one reciprocably movable low-mass hollow externally-grooved spring-biased gas-pressurized vane slidably mounted therein and slidably engaged with an associated roller piston. Each cylinder chamber has a gas suction port in the inner wall on one side of the vane slot communicating with the suction chamber. Each cylinder chamber has a plurality of gas discharge ports in the inner wall on the other side of the vane slot and each discharge port accommodates a spring- and gas-pressure biased, normally closed, gas-operated poppet type discharge valve which allow complete gas expulsion to the discharge chamber.

9 Claims, 22 Drawing Figures

U.S. PATENT DOCUMENTS

| | | | |
|---|---|---|---|
| 1,796,535 | 3/1931 | Rolaff | 418/249 |
| 2,048,218 | 7/1936 | Philipp . | |
| 2,129,431 | 9/1938 | Lambin | 418/94 X |
| 2,266,191 | 12/1941 | Granberg . | |
| 2,522,824 | 9/1950 | Hicks | 418/99 |
| 2,535,267 | 12/1950 | Cline . | |
| 2,552,860 | 5/1951 | Oliver . | |
| 2,612,311 | 9/1952 | Warrick et al. | 418/96 X |
| 2,883,101 | 4/1959 | Kosfeld | 418/94 X |
| 2,969,021 | 1/1961 | Menon . | |
| 3,056,542 | 10/1962 | Galin | 418/96 X |
| 3,178,103 | 4/1965 | Schnacke | 418/88 X |
| 3,193,192 | 7/1965 | Carter . | |
| 3,259,306 | 7/1966 | Porteous . | |
| 3,374,943 | 3/1968 | Cervenka | 417/DIG. 1 |
| 3,385,513 | 5/1968 | Kilgore | 418/147 |
| 3,421,413 | 1/1969 | Adams et al. | 418/82 |
| 3,463,090 | 8/1969 | Gordinier | 418/60 |
| 3,535,059 | 10/1970 | Kalkbrenner | 418/60 |
| 3,683,694 | 8/1972 | Granberg . | |
| 3,709,161 | 1/1972 | Kauffman . | |
| 3,797,975 | 3/1974 | Keller . | |
| 3,834,841 | 9/1974 | Falciai et al. . | |
| 3,838,950 | 10/1974 | Andriulis | 418/96 X |
| 3,883,273 | 5/1975 | King | 418/60 X |
| 3,976,403 | 8/1976 | Jensen . | |
| 3,976,407 | 8/1976 | Gerlach | 418/144 X |
| 4,012,181 | 3/1977 | Brulfert et al. . | |
| 4,035,112 | 7/1977 | Hackbarth et al. . | |
| 4,091,839 | 5/1978 | Donner | 137/539 X |
| 4,183,723 | 1/1980 | Hansen et al. . | |
| 4,204,815 | 5/1980 | LeBlanc . | |

ROTARY GAS COMPRESSOR HAVING ROLLING PISTONS

BACKGROUND OF THE INVENTION

1. Field of Use

This invention relates generally to rotary gas compressors having rolling pistons therein. In particular it relates to the construction and arrangement of the cylinder housing, cylinder chamber, vanes, suction ports, discharge valves, rotor assembly and seals employed in such compressors.

2. Description of the Prior Art

The prior art discloses various types of rotary gas compressors. Such compressors generally comprise a housing having a wall defining a cylinder chamber in which a roller piston mounted on an eccentric crankarm on a motor-driven shaft orbits in the cylinder chamber and rolls around the cylinder wall. The housing carries a reciprocably movable vane which is slidably mounted in a vane slot which communicates with the cylinder chamber and the vane slidably engages the roller piston. Gas enters the cylinder chamber through a suction port in the cylinder wall on one side of the vane slot. Compressed gas is periodically discharged from the cylinder chamber through a discharge valve mounted on the cylinder wall on the other side of the vane slot as the piston orbits and rotates. Single stage compressors usually employ one vane and an associated suction port and discharge valve. Multi-stage compressors employ a plurality of such vanes and associated suction ports and discharge valves. Multi-cylinder compressors, whether single or multi-stage, employ several cylinders and associated components in a ganged arrangement.

The following patents illustrate the state of the art of rotary gas compressors and related equipment. For example the following patents show multi-cylinder compressors or a plurality of compressors in stacked arrangement: U.S. Pat. Nos. 601,916; 4,012,181; 992,582; 1,053,767; 4,204,815; 1,083,710; 1,216,378.

The following patents show rolling piston-type compressors, some of which are two-stage: U.S. Pat. Nos. 2,226,191; 3,709,161; 2,535,267; 3,834,841; 2,552,860; 2,969,021; 3,683,694.

The following patents show valving arrangements in compressors and related equipment: U.S. Pat. Nos. 2,048,218; 2,394,166; 3,797,975; 4,183,723.

The following patent shows a common manifold for a plurality of compressors: U.S. Pat. No. 4,035,112.

The following patents depict compressor vanes of various types: U.S. Pat. Nos. 333,994; 3,280,940; 693,950; 1,649,256; 3,193,192; 3,259,306.

The following patents show piston constructions: U.S. Pat. Nos. 899,040; 1,216,378; 1,320,531; 3,976, 403.

Many prior art rotary gas compressors are so constructed that undesirable mechanical and operational problems are inherent therein. For example, some multi-cylinder compressors or ganged compressors employ an undue number of costly components of complex shape. Such compressors are difficult to manufacture and service and some employ many relatively movable parts which are subject to undue wear and breakdown, especially if lubrication systems are inefficiently designed. Some prior art multi-cylinder or ganged compressors employ rotor assemblies and rotors which create imbalance and vibration problems unless elaborate and painstaking balancing procedures and components are employed. Some prior art compressors employ relatively movable components, such as the vanes and discharge valves which are adversely or undesirably affected by gas pressure in parts of the system and reliability and efficiency are not at optimum levels. Some prior art compressors employ a type of gas discharge valve which is so constructed and located that there is incomplete expulsion of compressed gas from the piston chamber thereby resulting in system inefficiency and energy waste.

Other problems in prior art rotary compressors are identified and discussed in the aforementioned patents.

SUMMARY OF THE INVENTION

In accordance with the present invention there is provided a multi-cylinder rotary gas compressor of the rolling piston type which comprises a plurality of (four) modular cylinder housings, three partition plates and two end covers which are secured together in end-to-end arrangement as by bolts. Each cylinder housing comprises an inner wall which defines a centrally located cylinder chamber and a vane slot communicating with the cylinder chamber. Each cylinder housing also comprises an outer wall concentric with the inner wall and connected thereto by webs which defines a suction chamber, a discharge chamber and an oil chamber or reservoir surrounding the piston chamber. The suction chambers are connected end-to-end and to a common gas inlet port. The discharge chambers are connected end-to-end to a common gas discharge port. The oil chambers are connected end-to-end. An internally lubricated rotor assembly extends axially through the plurality cylinder chambers and comprises a shaft rotatably supported on bearings on the end covers. The shaft has a plurality of (four) eccentric crankarms thereon. A roller piston is rotatably mounted on each eccentric crankarm, one for each cylinder chamber. Sealing means are provided between the ends of each roller piston and the confronting side walls of the cylinder chamber. The pistons are angularly displaced from each other so that the rotor assembly is inherently balanced. Thus, in a four cylinder compressor the crankarms for the two central pistons are angularly displaced 180° from the crankarms for the two end pistons to provide balance and eliminate vibration. The rotor shaft drives an oil pump which is connected to receive oil from the oil chambers and deliver it to parts of the rotor assembly and to the vane slots. Each vane slot communicating with a cylinder chamber has a reciprocably movable low-mass hollow externally-grooved spring-biased gas-pressurized vane slidably mounted therein and extending into the cylinder chamber and each vane is slidably engaged with an associated piston. In a multi-stage compressor, a plurality of vanes, vane slots and related components would be provided in each cylinder chamber. Each cylinder chamber has a constantly open gas suction port in the inner wall on one side of the vane slot communicating with the suction chamber. Each cylinder chamber also has a plurality of gas discharge ports in the inner wall on the other side of the vane slot communicating with the discharge chamber. Each discharge port is provided with a spring-biased normally closed gas-operated poppet type discharge valve assembly. The discharge ports and valve assemblies in each cylinder chamber are preferably arranged in columns and rows. Each discharge valve assembly comprises a ball cage mounted in a discharge port in the cylinder wall, which cage has a hole and a chamfered or conical valve seat surface therearound against which a valve member, in the form of a ball or member having a conical end portion is seated and biased by a spring in the ball cage. Each valve member pops open as the roller piston rolls therepast to enable expulsion of compressed gas from the cylinder chamber. Each discharge port and valve assembly is constructed and sized to reduce the amount of entrapped unexpelled compressed gas remaining in the cylinder chamber.

A compressor in accordance with the present invention offers several advantages over the prior art. For example, the rotor shaft and the eccentric crankarms thereon are arranged so that when the rotors are disposed on the crankarms, and the rotor assembly is in operation, forces are symmetrically applied to the rotor assembly and it comes very close to being perfectly balanced. This substantially reduces compressor vibration and eliminates the need for special counterweights.

The cylinder housings are of modular construction so that any desired numbers of housings can be secured together in end-to-end relationship. Preferably, the housings are used in multiples of four and the rotor assembly for each set of four cylinder housings is constructed so that the two central pistons are angularly displaced 180° from the two end pistons so as to provide for balance and eliminate vibration.

The crankshaft of the rotor assembly and the rollers rotatably mounted on the eccentric crankarms thereon are lubricated from the oil pump through oil passages in the crankshaft and the vanes and vane slots are also lubricated by the oil pump. The oil chamber or reservoir is located in the cylinder housing directly below the cylinder chamber and corresponds to the crankcase of a reciprocating compressor. The oil pump is located on the end of the rotor assembly crankshaft and supplies oil for lubrication, as explained.

The components from which the housing assembly is constructed, such as the cylinder housings, partition member, seals and gaskets, vanes, and discharge valve assemblies, are similar to one another whenever possible so that modularity and interchangeability of components is possible.

The suction chambers, discharge chambers and oil chambers in each cylinder housing are joined end-to-end internally in the housing assembly. This arrangement eliminates unnecessary external piping, tubing and associated connectors. The gas suction port between the gas suction chamber and the cylinder chamber is relatively large and constantly open, thereby insuring efficient gas flow and eliminating the need for valves.

Each vane is constructed with large spaces therein so as to reduce its mass and reduce inertia problems as it moves. Furthermore each vane is provided on its exterior with grooves which reserve and retain oil supplied from the oil pump to thereby more effectively seal against leakage of gas through the opening in which the vane reciprocatingly moves. Each vane is held in tight engagement with the surface of the roller piston which it engages by means of a compression spring and also by means of compressed gas supplied through a passage either from the discharge side of the compressor or from a receiver downstream of a condensor in the compressor system. The use of compressed gas is preferable because spring loading alone would not exert sufficient force at certain times in the operational cycle.

The discharge port and valve assemblies are so constructed, arranged and sized that they allow for virtually complete expulsion of compressed gas from the cylinder chamber to the discharge chamber on each orbit of the roller piston. This comes about because each valve member when seated and its associated structure leaves only a very small amount of space remaining between the valve member and the roller piston moving therepast during the exhaust cycle. As a consequence, very little compressed gas can accumulate in such a small space, which compressed gas would otherwise be inefficiently recirculated and re-expanded within the cylinder chamber. Such re-expansion and recirculation occurs in prior art compressors. Furthermore the use of many relatively small gas discharge valves effectively eliminates the single relatively large space associated with a single relatively large discharge valve in prior art compressors. Such large discharge valves are also prone to open and close erratically and create vibration problems.

Other objects and advantages of the invention will hereinafter appear.

DESCRIPTION OF PREFERRED EMBODIMENT

Figure 1:
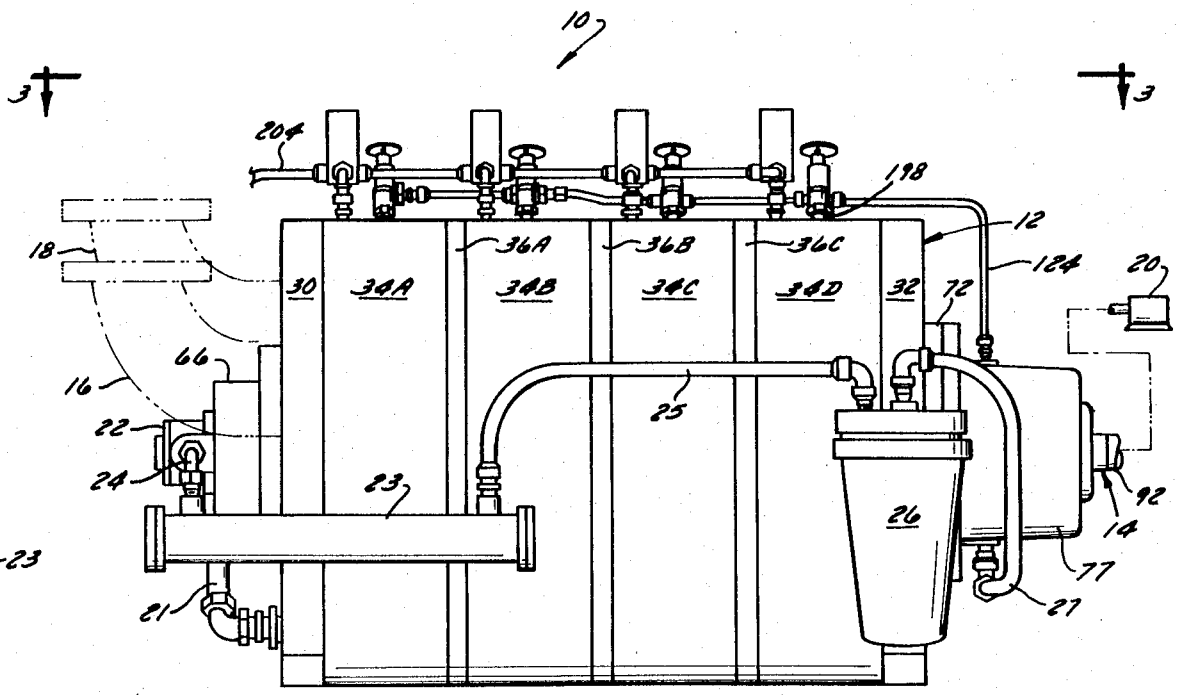
FIG. 1 is a side elevation view of a multi-cylinder single-stage rolling piston type gas compressor in accordance with the present invention.
Figure 2:
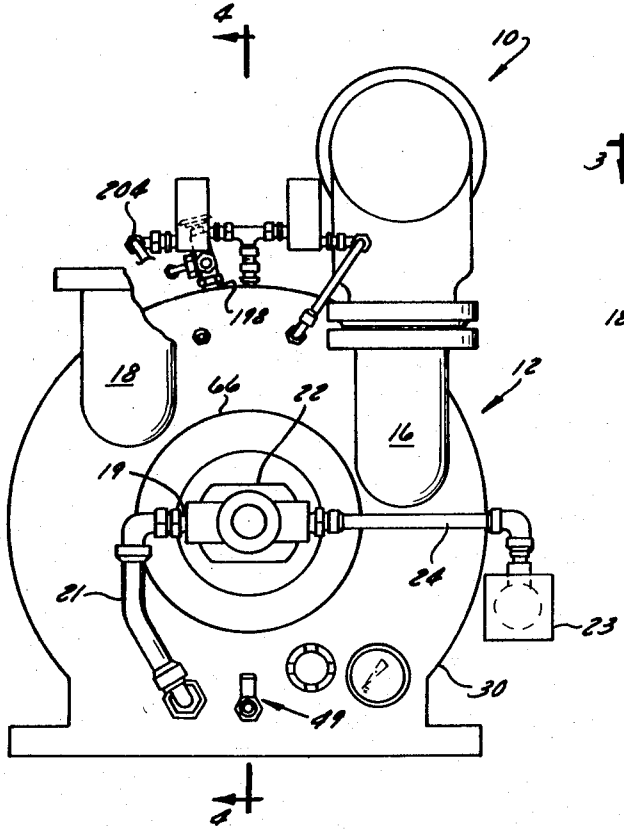
FIG. 2 is an end elevation view of the compressor of FIG. 1.
Figure 3:
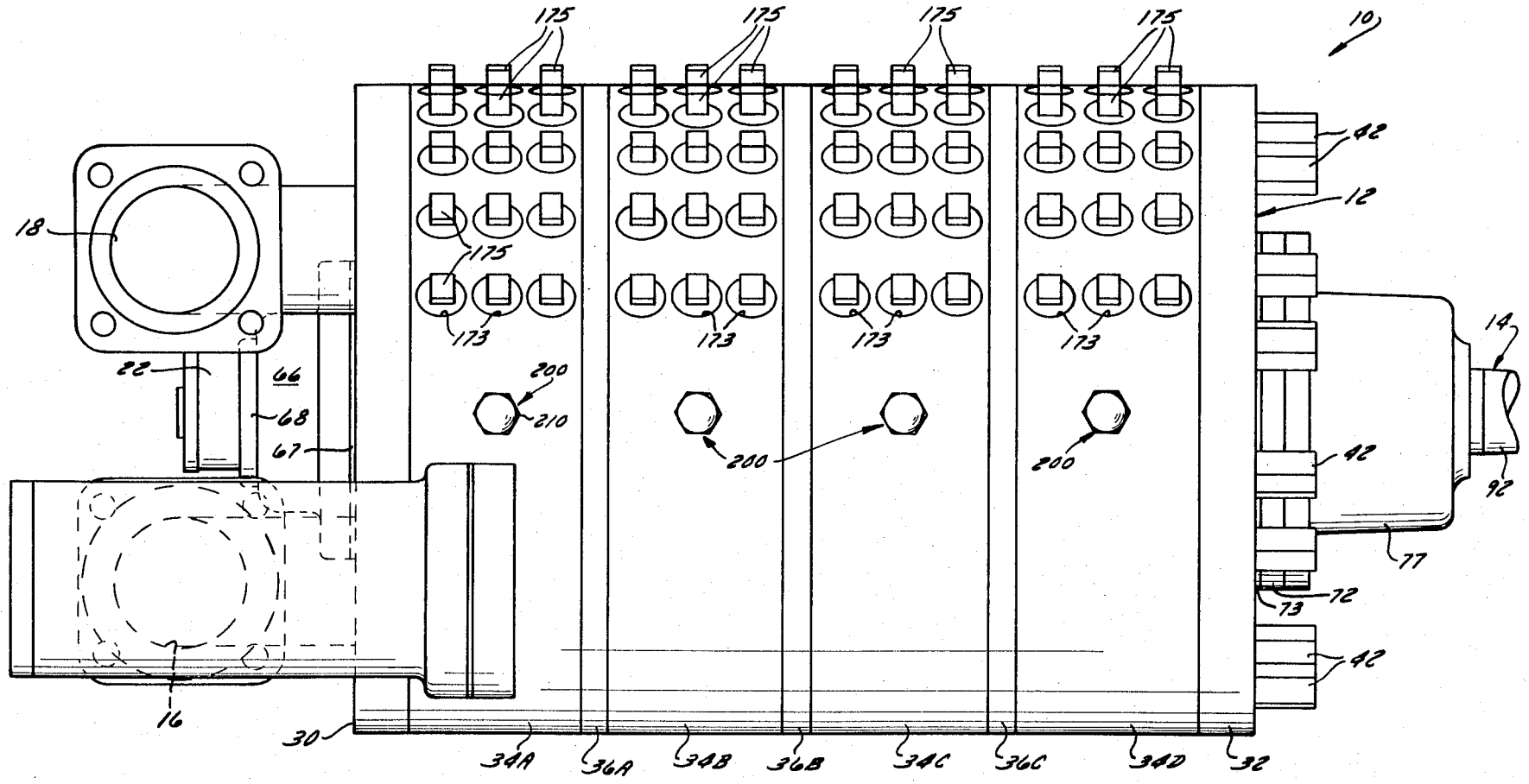
FIG. 3 is an enlarged top plan view of the compressor shown in FIGS. 1 and 2.
Figure 4:
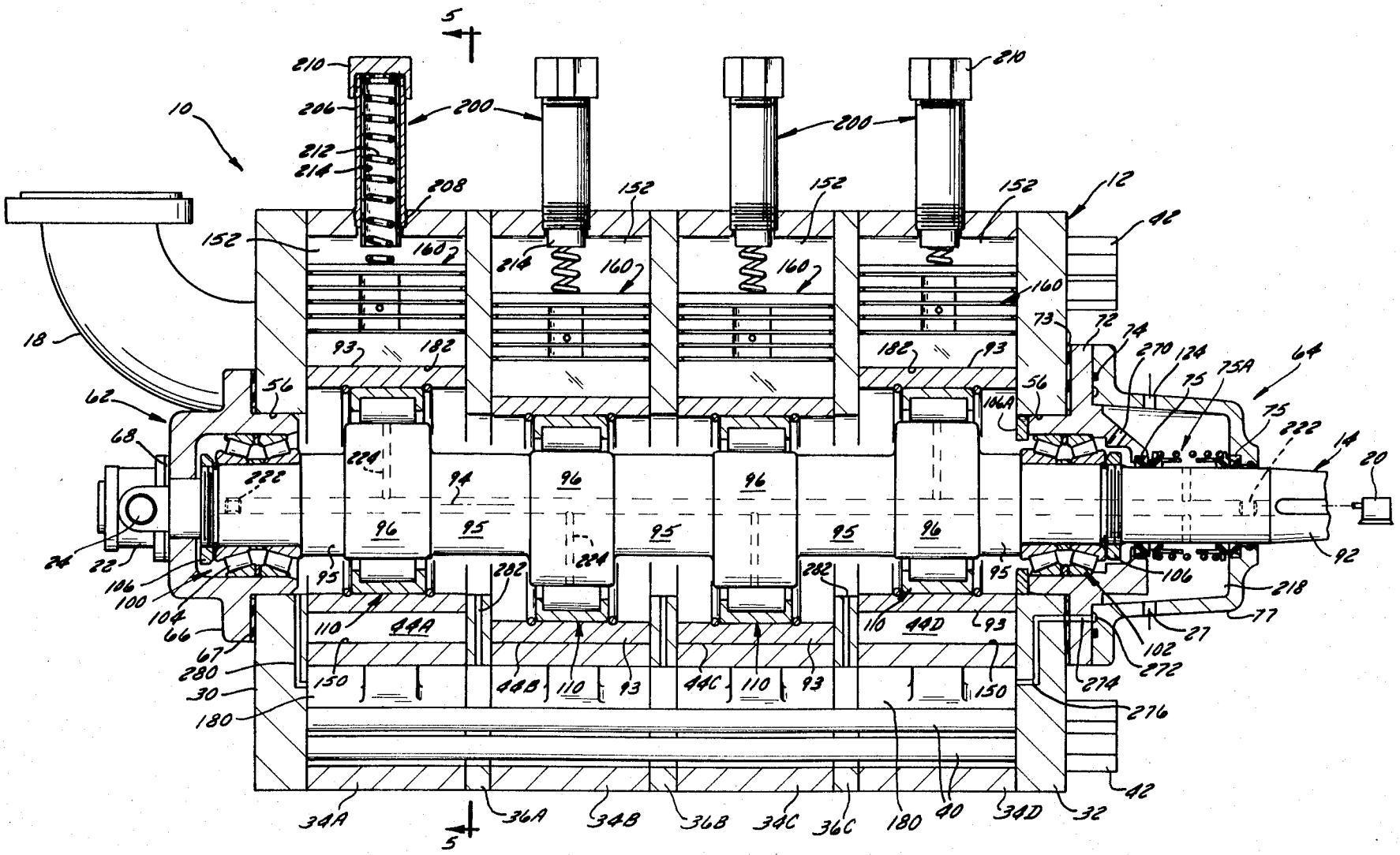
FIG. 4 is a cross-sectional view of the compressor taken on line 4—4 of FIG. 2.

Referring to FIGS. 1 through 5, the numeral 10 designates a multi-cylinder single-stage rolling piston type gas compressor in accordance with the present invention. Compressor 10 comprises a housing assembly 12, also shown in FIG. 6, in which four cylinder chambers 44A through 44D, shown in FIG. 4, are provided and in which a rotor assembly 14, including a crankshaft 92 and four roller pistons or rotors 93, is mounted, as FIGS. 4, 5 and 13 make clear. Housing assembly 12 is provided with a gas inlet or suction port 16 and a compressed gas outlet or discharge port 18 at one end. Crankshaft 92 of rotor assembly 14 is driven at one end by, for example, an electric motor 20, as FIG. 1 shows. Housing assembly 12 is provided with an oil pump 22, shown separately in FIG. 14, driven by shaft 92 of rotor assembly 14 which supplies lubricating oil from a line 21 connected to an oil sump 180 (FIG. 4) through an oil supply line 24, an oil cooler 23, an oil supply line 25, an oil filter 26 and an oil supply line 27 to certain components of compressor 10, as hereinafter described. In operation, motor 20 drives shaft 92 of rotor assembly 14 and compressible gas entering inlet or suction port 16 is compressed within housing assembly 12 and supplied from discharge port 18.

As will be understood, compressor 10 is usable, for example, in any one of the four refrigeration systems shown in FIGS. 19, 20, 21 and 22 and hereinafter described in detail. In each of those four systems, broadly considered, compressed gas from discharge port 18 of compressor 10 is delivered through an oil separator 29 to a condenser 31 wherein it condenses into a liquid and, after passing therefrom through a receiver 35 and an expansion valve 33, into an evaporator 37 wherein it expands to effect cooling, and from whence it is supplied to suction port 16 of compressor 10 for recompression.

As FIGS. 1 through 12 show, housing assembly 12 has a pump end cylinder cover 30 at one end and a shaft end cylinder cover 32 at the other end. Between these two covers 30 and 32 are arranged four cylinder housings 34A, 34B, 34C, 34D; three cylinder partitions 36A, 36B, 36C; and eight sealing gasket assemblies 38 (see FIG. 12) which are secured together by a plurality of elongated tie-bolts 40 (FIGS. 4, 5, 7 and 8) which are threaded at both ends and have nuts 42 at one end. Each cylinder housing 34A–34D and its adjacent components defines a compressor cylinder and in the embodiment shown four cylinder chambers 44A, 44B, 44C, 44D are included as FIG. 4 shows.

Figure 8:
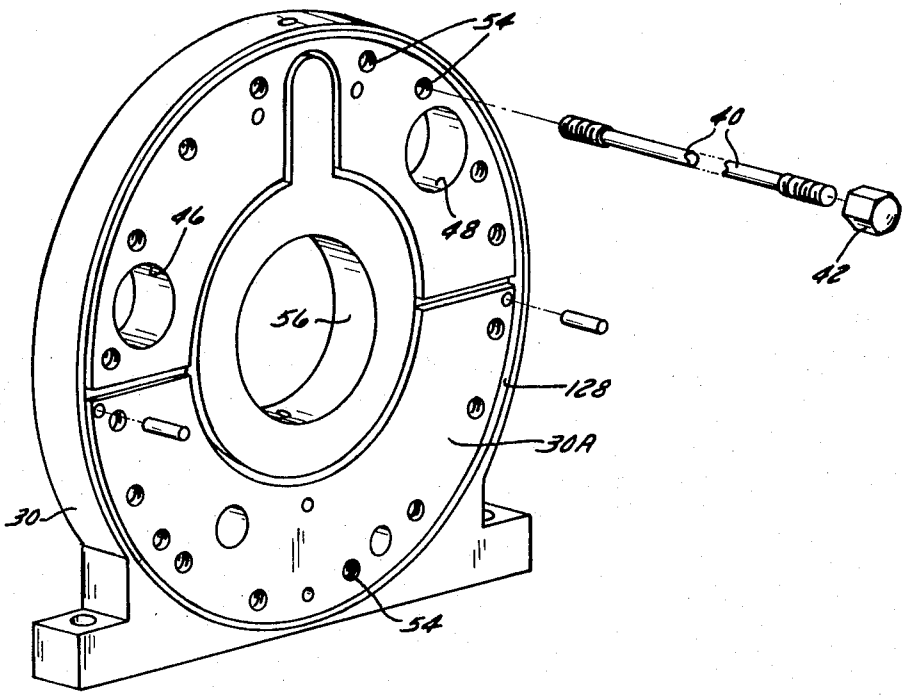
FIG. 8 is a perspective view of the inside of the cover shown in FIG. 7.
Figure 7:
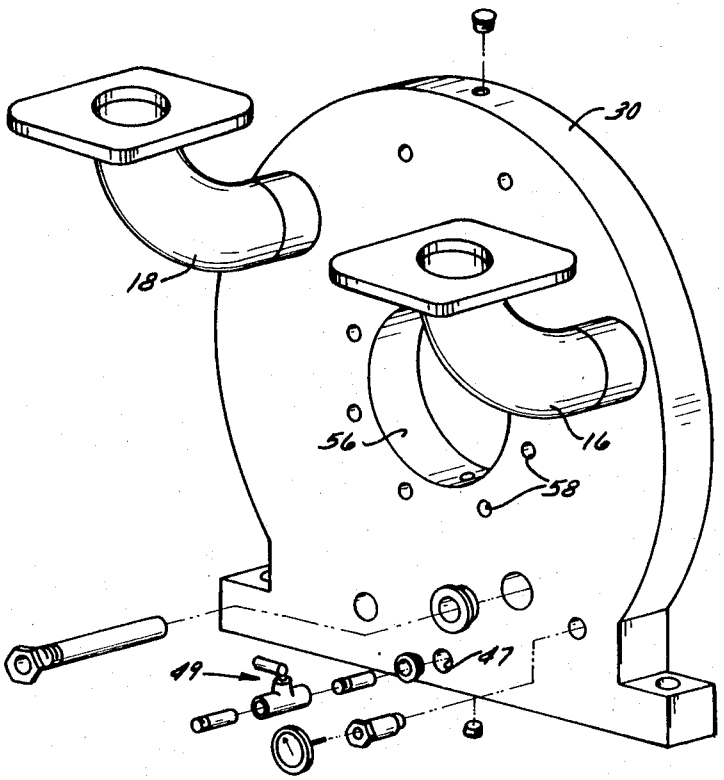
FIG. 7 is a perspective view of the outside of the pump end cover plate of the compressor shown in FIG. 6.
Figure 9:
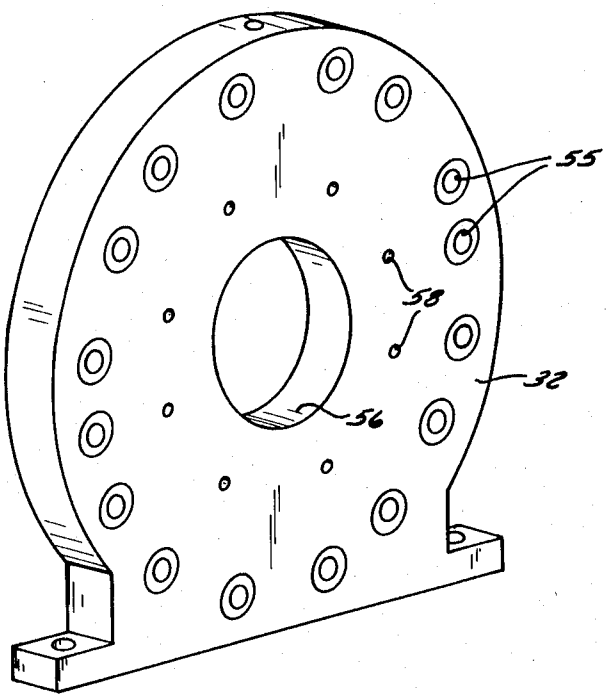
FIG. 9 is a perspective view of the outside of the drive end cover of the compressor housing.

As FIGS. 7 and 8 best show, the cylinder cover 30 has openings 46 and 48 to which the gas port pipes 16 and 18 are connected to define the suction and discharge ports, respectively. Cover 30 also has an oil sump drain hole 47 and drain valve assembly 49 therefor. The cylinder cover 30 has a plurality of tapped bores 54 for receiving the tie-bolts 40. The cylinder cover 32 has a plurality of holes 55 through which the tie-bolts 40 extend. The covers 30 and 32 each have a central hole 56 for accomodating portions of the shaft 92 of the rotor assembly 14. Each central hole 56 is surrounded by a plurality of tapped bolt holes 58 (FIGS. 7 and 9) which accomodate bolts 60 (FIG. 13) which secure the rear and front bearing housing assemblies 62 and 64, respectively, for shaft 92 to the covers 30 and 32, respectively.

Figures 13, 14, 15:
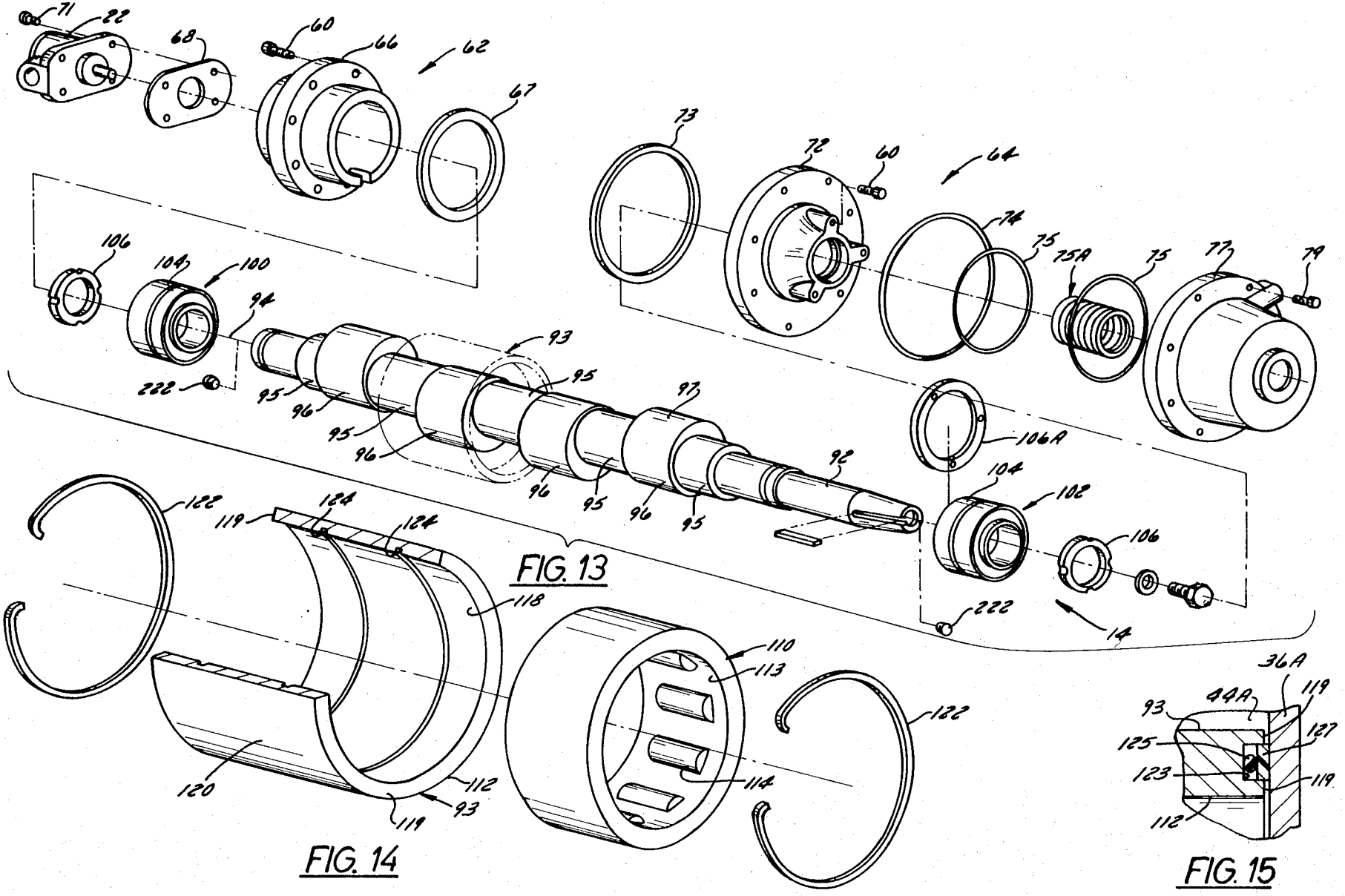
FIG. 13 is an exploded perspective view of the rotor assembly for the compressor.
FIG. 14 is an enlarged prospective view of the roller piston or rotor of the rotor assembly of FIG. 13.
FIG. 15 is a cross-section view of the roller piston end seal.

As FIGS. 4 and 13 show, rear bearing housing assembly 62 comprises a bearing support housing 66 having a face seal 67 on one side and a pump gasket seal 68 on its other side and oil pump 22 is secured to housing 66 by bolts 71. As FIGS. 4 and 13 show, front bearing housing assembly 64 comprises a bearing support housing 72 having a face seal 73 on one side and an O-ring 74 on its other side and an end cap 77 secured to housing 72 by bolts 79. A mechanical seal assembly 75A is provided to seal the shaft 92 and the pair of O-rings 75 cooperate therewith.

Figure 5:
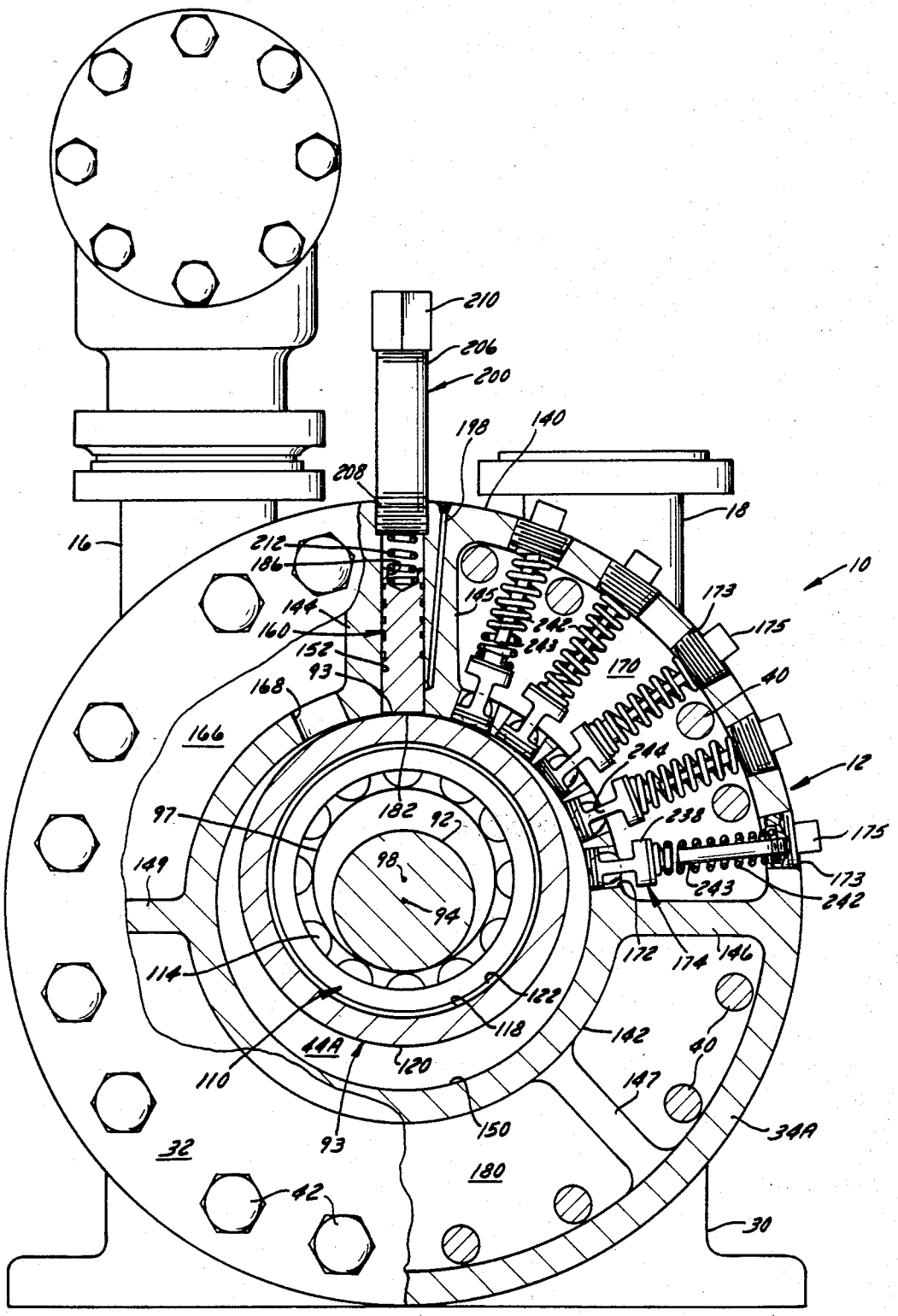
FIG. 5 is an enlarged end elevation view, partly in section, showing the discharge valves of the compressor.

As FIGS. 4, 5 and 13 show, rotor assembly 14 comprises a crankshaft 92 having a longitudinal axis of rotation 94 and having four eccentric crankarms 96 integrally formed with the shaft between the shaft portions 95. Shaft 92 of rotor assembly 14 further includes four roller pistons or rotors 93, one on each crankarm 96. Each crankarm 96 has a cylindrical exterior surface 97 (FIGS. 5 and 13) and the axis 98 of the crankarm is displaced from but parallel to the longitudinal axis of rotation 94 of the crankshaft 92. The two centrally located crankarms 96 have their axes 98 in axial alignment with each other. The two outermost crankarms 96 located near the ends of crankshaft 92 have their axes 98 in axial alignment with each other but these axes are located 180° from the axes 98 of the two central crankarms 96.

As FIGS. 4 and 13 make clear, crankshaft 92 is supported for rotation at its opposite ends by main bearing assemblies 100 and 102 which, in turn, are mounted within the rear and front bearing housing assemblies 62 and 64, respectively, on the housing covers 30 and 32, respectively. Bearing assemblies 100 and 102 each comprise a roller bearing 104 and a retainer nut 106. Bearing assembly 102 also includes a front bearing retainer ring 106A.

As FIG. 14 shows, each roller piston or rotor 93 comprises an inner roller bearing assembly 110 and an outer rotor member 112 is mounted on and surrounds bearing assembly 110. Bearing assembly 110 comprises bearing race 113 which carries a plurality of rollers 114 closely fitted on a crankarm 96, and race 113 is rotatable relative to crankarm 96. Outer rotor member 112, which takes the form of a hollow cylinder having an inside surface 118 and an outside surface 120 and edge surfaces 119, is closely fitted on the bearing race 113 of bearing assembly 110 and is prevented from axial displacement thereon by means of snap rings 122 which are located at opposite ends of the race 113 and engage annular grooves 124 formed in the inside surface 118 of outer rotor member 112. As FIG. 15 shows, each edge surface 119 of rotor member 112 is provided with sealing means to prevent gas leakage between the edge and the side wall of a cylinder 44A, 44B, 44C, 44D and such means comprise an annular groove 123 in the edge surface 119 in which is disposed a compressible O-ring 125 and an annular Teflon (TM) ring 127 which is biased outwardly of the groove by the O-ring. Ring 127 bears against an end wall 30 or 32, or against a portion of a partition 36A, 36B, 36C, depending on its location. When in operation, as hereinafter explained, rotor member 112 rotates around the axis 98 of its crankarm 96 and also orbits around the longitudinal axis of rotation 94 of crankshaft 92 as the latter is rotatably driven.

As previously stated, housing assembly 12 of compressor 10 includes four cylinder chambers 44A–44D. Referring to FIG. 4 and proceeding from the pump end (left end) to the shaft end (right end) of the housing assembly 12, it is seen that the first cylinder 44A is defined by pump end cylinder cover 30, the first cylinder housing 34A and the first cylinder partition 36A. The second cylinder 44B is defined by the first partition 36A, the second cylinder housing 34B and the second cylinder partition 36B. The third cylinder 44C is defined by the second cylinder partition 36B, the third cylinder housing 34C and the third cylinder partition 36C. The fourth cylinder 44D is defined by the third cylinder partition 36C, the fourth cylinder housing 34D and the shaft end cylinder cover 32.

Since the four cylinder housings 34A through 34D are identical to each other in size and construction and the three cylinder partitions 36A through 36C are identical to each other in size and construction, only cylinder housing 34A (see FIG. 11) and cylinder partition 36A (see FIG. 12) are hereinafter described in detail. Each cylinder housing 34A and each cylinder partition 36A is preferably formed by casting and subsequent machining.

Figure 10:
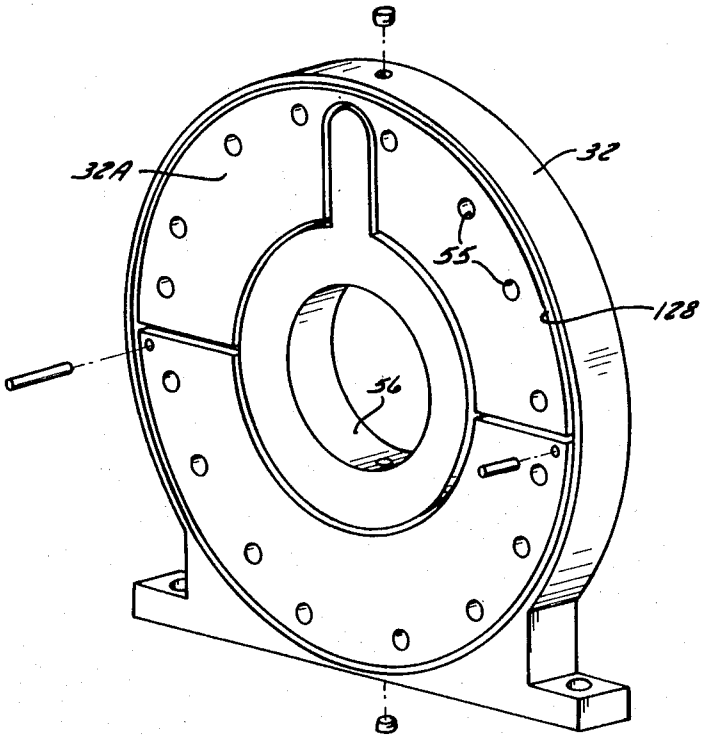
FIG. 10 is a perspective view of the inside of the cover shown in FIG. 9.
Figure 12:
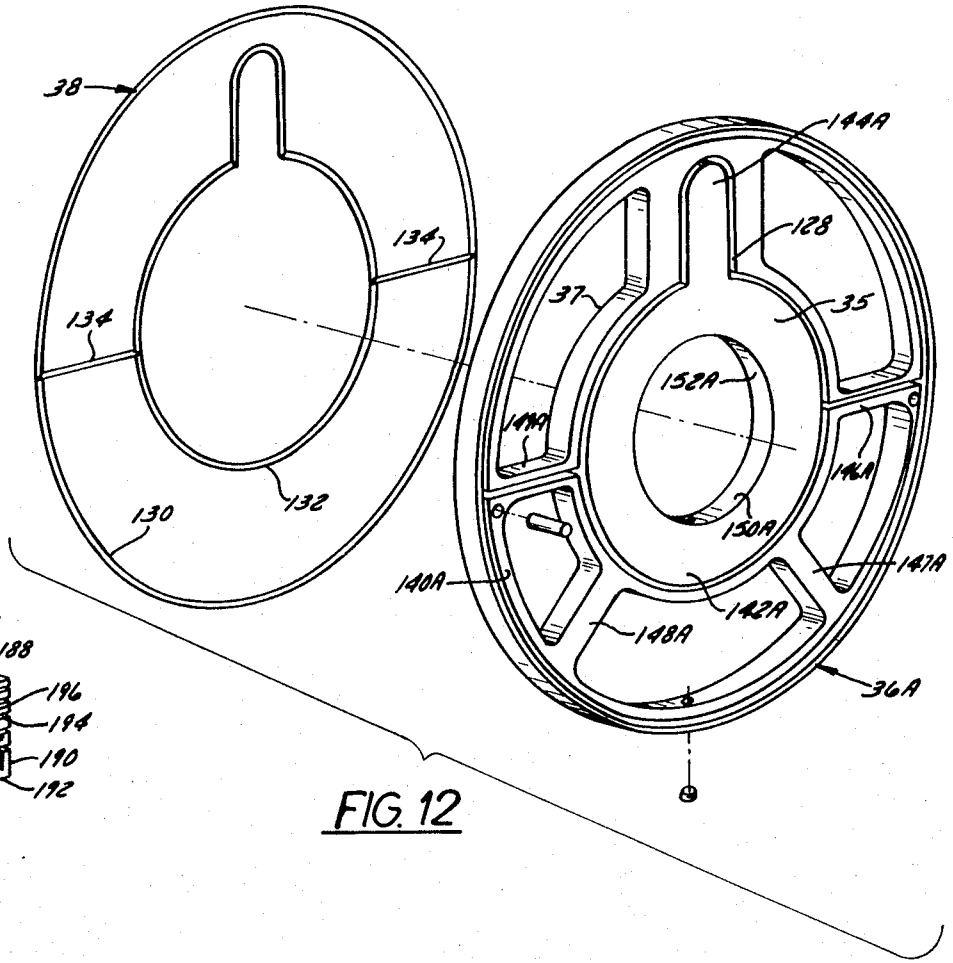
FIG. 12 is a perspective view of one of the housing partition members and a gasket associated therewith.

Sealing means are provided on the opposite ends of each cylinder 44A–44D and such sealing means comprise a sealing gasket 38 (see FIG. 12) which is fabricated of cast Neoprene (TM) or the like and comprises an outer circular ring member 130 which is joined to an inner ring member 132 by two integrally formed straight members 134. As FIGS. 8, 10 and 12 show, ring-receiving grooves 128 are formed as by casting or machining on the inner faces 30A and 32A of the end plates 30 and 32, respectively, and on both faces 35 and 37 of each of the three cylinder partitions 36A, 36B, 36C. Each groove 128 corresponds in size and shape to the associated sealing gasket assembly 38.

Figure 6:
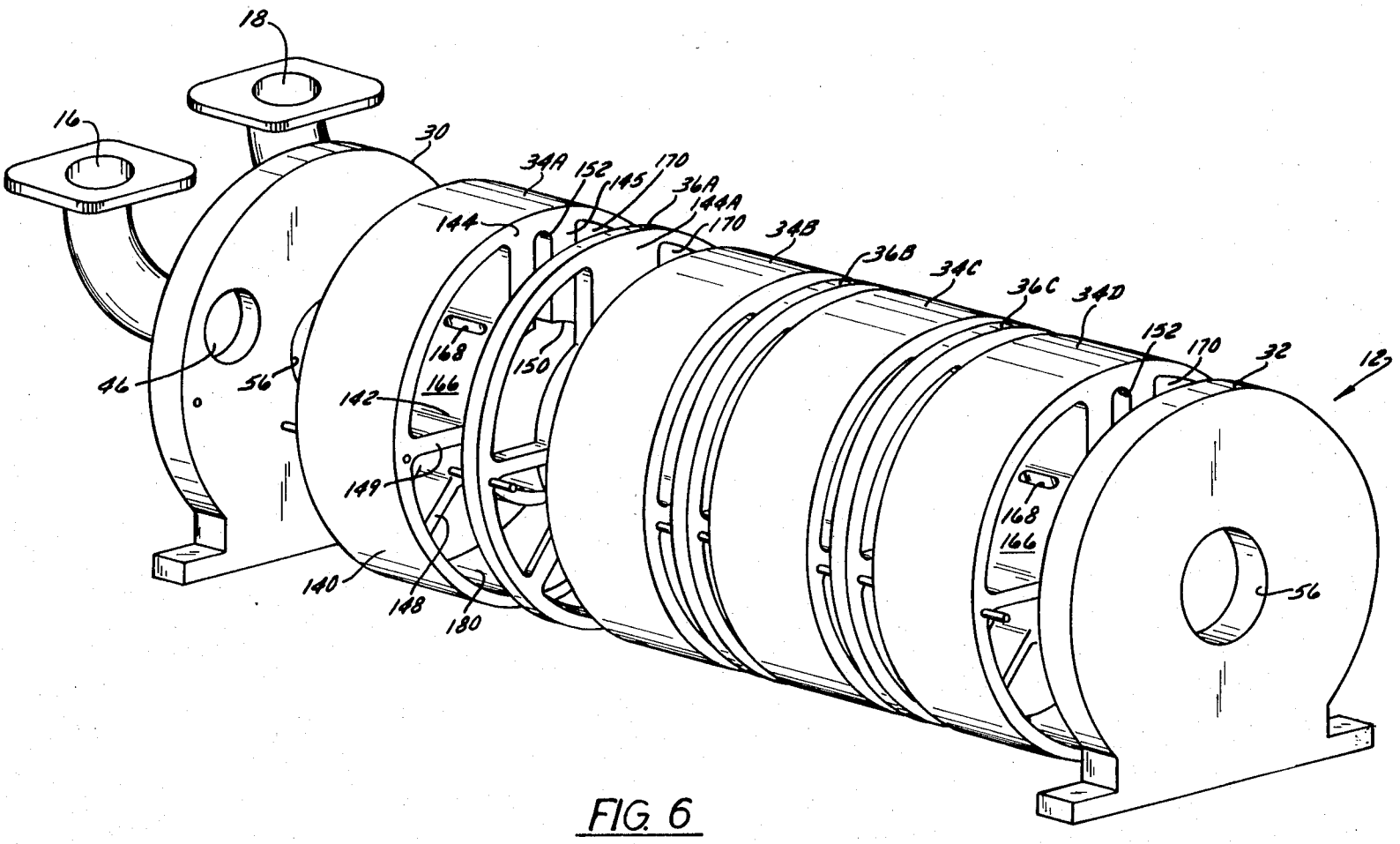
FIG. 6 is a perspective view of portions of the housing assembly of the compressor.
Figure 11:
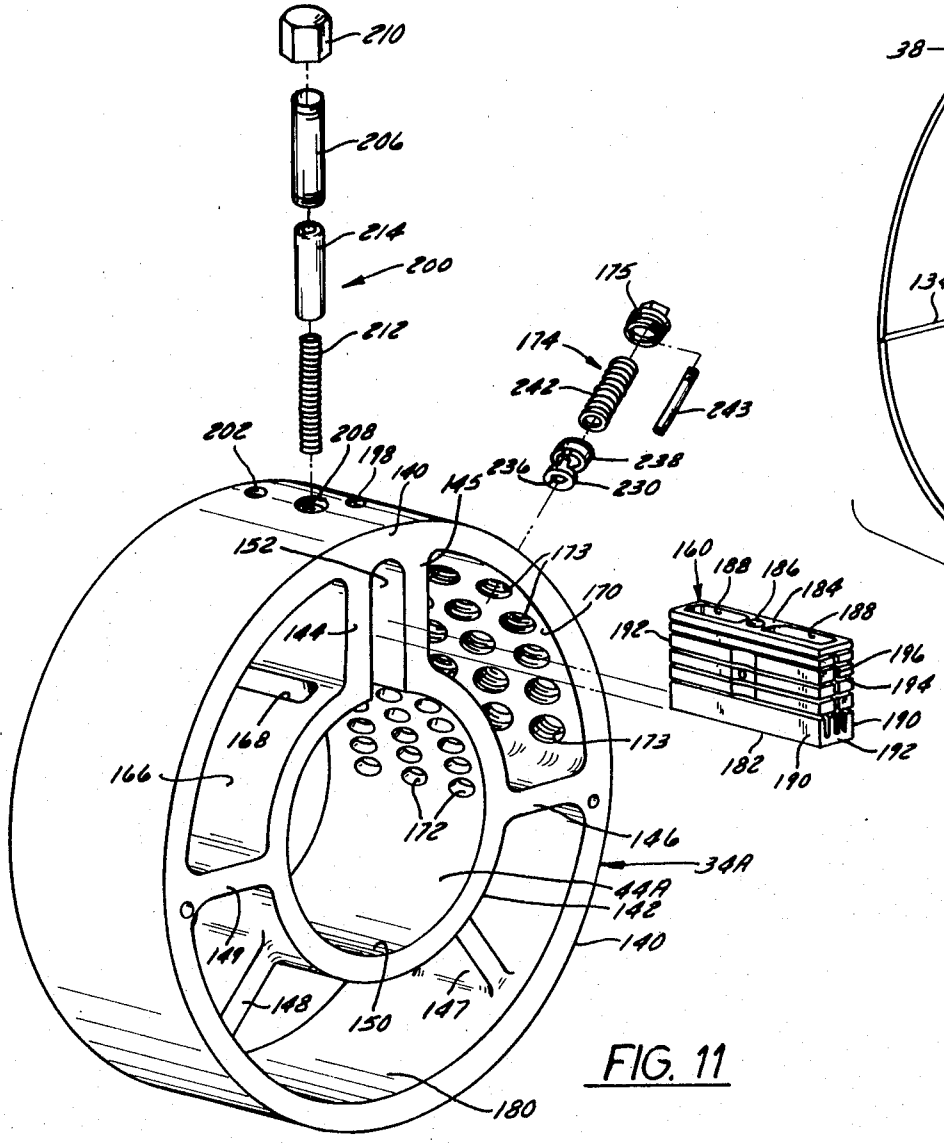
FIG. 11 is a perspective view of one of the cylinder housings of the compressor and of the vane associated therewith.

As. FIGS. 6 and 11 show, cylinder housing 34A comprises an outer cylindrical wall 140, an inner cylindrical wall 142, and six integrally formed webs 144, 145, 146, 147, 148, 149 connected between the walls 140 and 142 to provide support therefor and to cooperate therewith to provide chambers hereinafter identified. The pump end cylinder wall 30 and the first cylinder partition 36A cooperate with cylinder housing 34A to define and, where necessary, enclose the aforesaid chambers. As FIG. 12 shows, cylinder partition 36A comprises walls 140A and 142A and webs 146A, 147A, 148A, 149A which register with correspondingly numbered (but unsuffixed) components on cylinder housing 34A, except that in partition 36A a wall 144A bridges the end of vane slot 152 in cylinder housing 34A to enclose that slot. Partition 36A comprises a shaft hole 150A and a wall portion 152A serving as a cylinder wall.

Inner cylindrical wall 142 defines and surrounds cylinder chamber or cylinder 44A and the associated roller piston or rotor 93 makes point contact with and rolls around the inner surface 150 of the cylinder. Cylinder 44A communicates directly with an opening or slot 152 which is defined by the spaced apart webs 144 and 145 and a portion of outer wall 140. Slot 152 slidably receives a reciprocably movable vane 160, hereinafter described in detail, which engages the outer surface of rotor 93 as the latter rotates and orbits to divide the cylinder 44A into two variably sized portions (except in one case where those two portions momentarily become one). It is to be understood that each cylinder 44A–44D is isolated from direct connection to an adjacent cylinder by the sealed engagement of the Teflon (TM) member 127 on rotor edge 119 with the surface of the associated partition member 36A–36C surrounding hole 150A.

Inner cylindrical wall 142, outer cylindrical wall 140, web 149 and web 144 cooperate to define a gas inlet or suction chamber 166 which communicates constantly and directly with cylinder 44A through a suction port or passage 168 formed in inner wall 142 of housing 34A on one side of the vane slot 152.

Inner cylindrical wall 142, outer cylindrical wall 140, web 146 and web 145 cooperate to define a gas outlet or discharge chamber 170 which communicates directly but intermittently with cylinder 44A through a plurality of discharge ports 172 formed in inner wall 142 of housing 34A on the other side of the vane slot 152 and having normally closed poppet valve assemblies, such as assembly 174 hereinafter described and shown in detail in FIGS. 5 and 16, herein.

Inner cylindrical wall 142, outer cylindrical wall 140, web 146 and web 149 cooperate to define an oil sump chamber 180. The webs 147 and 148 in chamber 180 serve to provide mechanical strength but do not provide for any further chamber division.

It is to be understood that in the fully assembled and operating compressor 10 the four suction chambers 166 are in direct end-to-end communication with each other and the suction port 16 connects directly to the first such chamber. Similarly, the four discharge chambers 170 are in direct end-to-end communication with each other and the discharge port 18 connects directly to the first such chamber. Similarly, the four oil sump chambers 180 are in direct end-to-end communication with each other and the inlet port 19 (see FIG. 2) of oil pump 22 is connected to the first such chamber by oil line 21.

As FIGS. 4, 5 and 11 show, the vane 160 takes the form of a one-piece member having a lower end surface 182 which bears against its associated rotor 93; an upper end surface 184 in which a spring-receiving hole 186 and weight-reducing recesses 188 are formed, two outer side surfaces 190 and two outer end surfaces 192. The surfaces 190 and 192 are provided with a plurality of continuous horizontally disposed, vertically spaced apart oil flow grooves 194 which are interconnected by one or more vertical grooves 196 (only one visible in FIG. 11).

The grooves 196 and 194 are supplied with lubricating oil from oil sump chamber 180 by means of oil pump 22 which, as FIGS. 1, 2, 5 and 11 show, supplies oil from end housing 77 through an oil supply line 124 and an oil passage 198 (see FIG. 5) which is formed in outer cylindrical wall 140 and web 145 of cylinder housing 34A on the upper side thereof and communicates with the vane slot 152 near the lower end thereof. As vane 160 reciprocates, oil continuously fills the grooves 194 and 196 therein to prevent leakage of gas from cylinder 44A outwardly past the vane.

Figure 19:
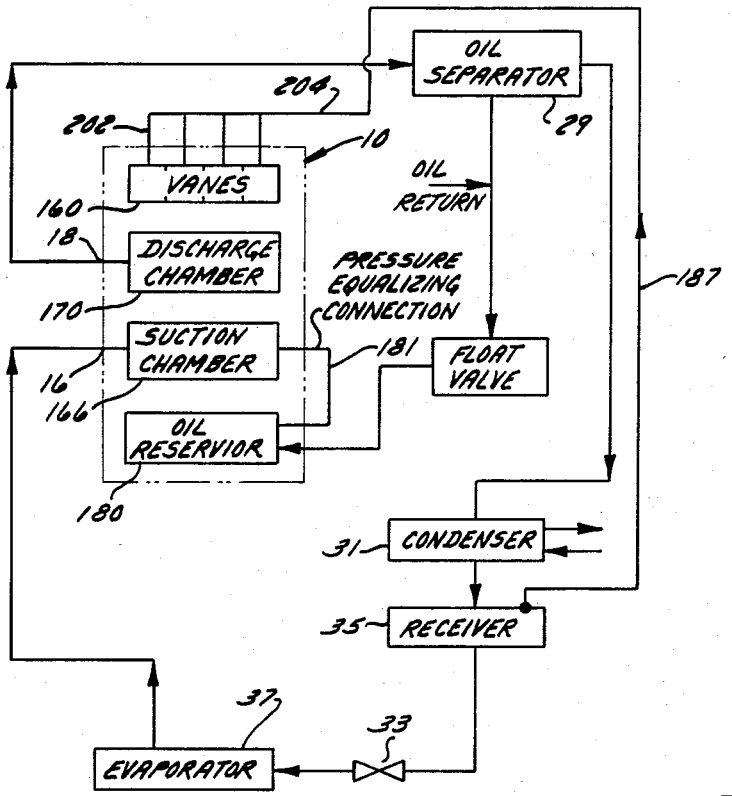
FIG. 19 is a schematic diagram of a first system employing a compressor in accordance with the invention and wherein gas for vane pressure is supplied from the system receiver and wherein the suction chamber and oil reservoir are connected together at low pressure.
Figure 20:
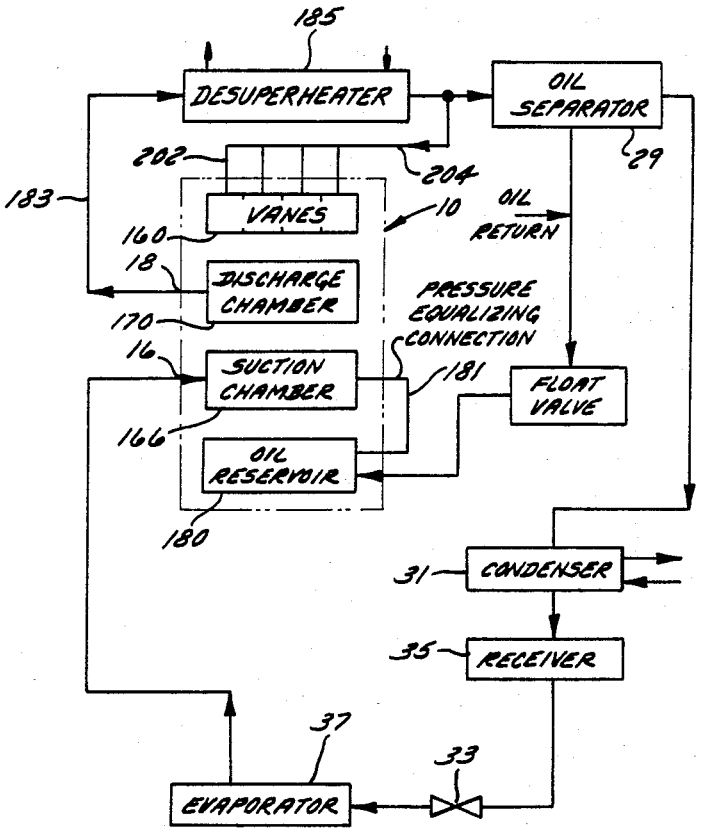
FIG. 20 is a schematic diagram of a second system, in accordance with the invention and wherein gas for vane pressure is supplied from the discharge chamber through a desuperheater and wherein the suction chamber and oil reservoir are connected together at low pressure.
Figure 21:
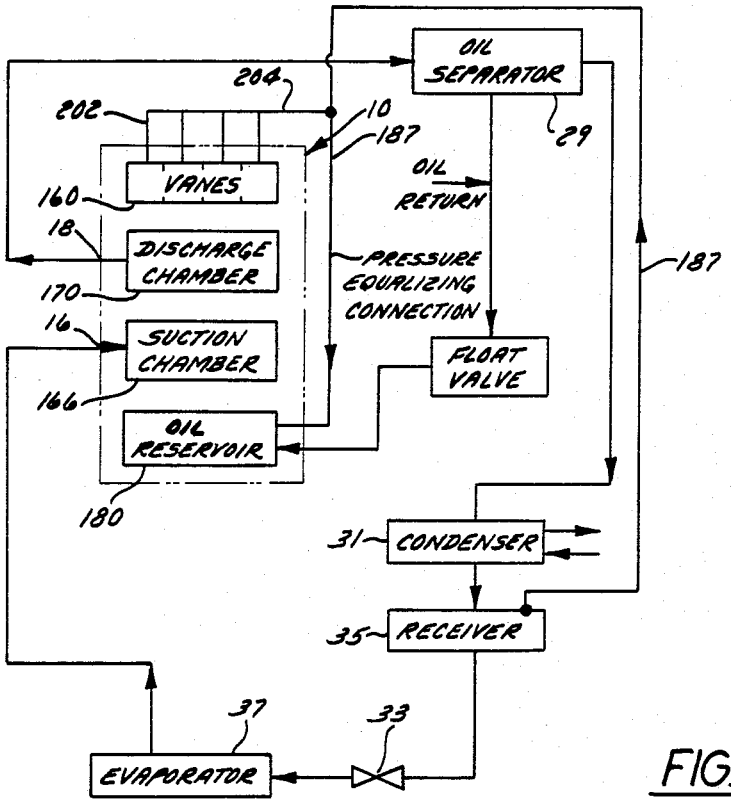
FIG. 21 is a schematic diagram of a third system similar to the first system but wherein the suction chamber and oil reservoir are not interconnected and high pressure is applied to the oil reservoir.
Figure 22:
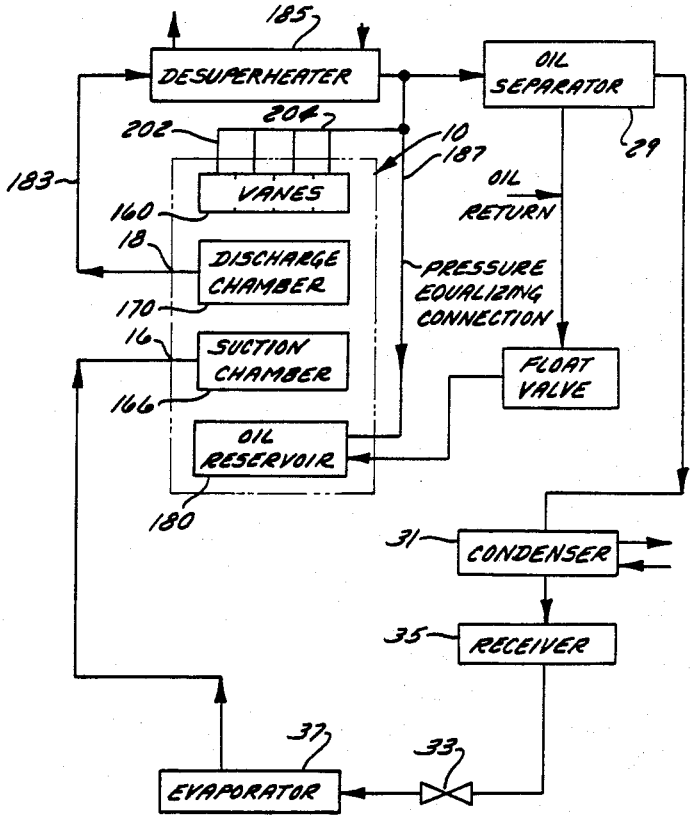
FIG. 22 is a schematic diagram of a fourth system similar to the second system but wherein the suction chamber and oil reservoir are not interconnected and high pressure is applied to the oil reservoir.

As FIGS. 1, 2, 4, 5 and 11 show, means are provided to bias the vane 160 against rotor 93 and such means include a spring-biasing assembly 200 and a gas pressure passage 202 (FIG. 11) which is connected by compressed gas supply line 204 (FIGS. 1, 2) either to the discharge chamber 170 (as shown in FIGS. 20 and 22) or to the receiver 35 (as shown in FIGS. 19 and 21). As FIGS. 4, 5 and 11 show, the spring-biasing assembly 200 comprises a hollow extension member 206, externally threaded at opposite ends, which is screwed into a threaded bore 208 which extends through outer cylinder wall 140 and communicates with the upper end of vane slot 152. A cap 210 screws onto and closes the outer end of extension member 206. Within hollow member 206 there is disposed a helical compression type biasing spring 212 having an outer spring guide tube 214 therearound. Spring 212 is entrapped between bore 186 in vane 160 and cap 210 of extension member 206.

As FIG. 4 shows, in addition to providing pressurized oil lubrication to the vanes 160, to the vane slots 152 and to their related spring-biasing assemblies 200 as hereinbefore explained, the oil pump 22 supplies oil from line 27 to the space 218 formed in the housing 77 and from thence, through a passage 219 in shaft 92 to an axially arranged main oil passage 220 in crankshaft 92 which extends entirely therethrough and is enclosed at both ends by screw plugs 222 (see FIG. 13). Crankshaft 92 further includes radially extending oil passages 224 which connect with main oil passage 220 and open into the space between each eccentric crankarm 96 and its bearing assembly 110. Oil then flows freely to the space between each crankshaft portion 95 and eventually returns to the sump 180. As FIG. 4 shows, at the drive end of shaft 92, oil is able to flow from space 218 in housing 77 through a bleed hole 270 to bearing assembly 102 and through passages 272, 274, 276 (in members 77, 72, 32, respectively) to the oil sump chamber 180. At the pump end of shaft 92 a passage 280 in cover 30 enables oil flow from housing 66 to oil sump 180. Oil return passages 282 are also provided in each partition member 36A, 36B, 36C.

Figure 16:
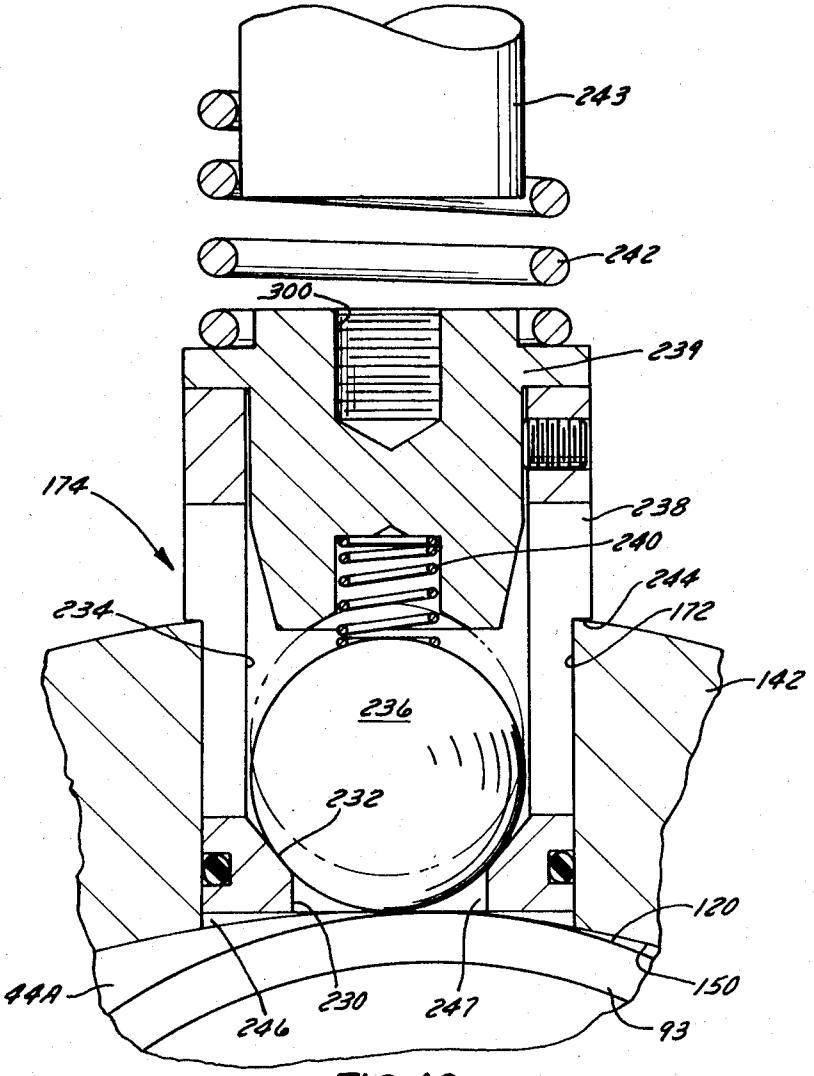
FIG. 16 is a greatly enlarged-cross-sectional view of one embodiment of a discharge valve for the compressor in accordance with the present invention.

Referring now to FIGS. 3, 5, 11, 16 and 17, the discharge ports 172 formed in the inner wall 142 of housing 34A and the normally closed poppet valve assemblies 174 therefor will now be described in detail. In the embodiments of the invention disclosed herein fifteen ports 172 are employed for each cylinder chamber 44A, and are arranged in three vertical radial rows and five horizontal columns, with five ports in each row and three ports in each column. Such arrangement allows for practically the entire surface of inner cylinder wall 142 which is directly opposite discharge chamber 170 to be occupied by discharge ports 172 thus helping to ensure very efficient compressed gas discharge from cylinder chamber 44A. Each port 172 is aligned with an appropriate one of a plurality of associated similarly arranged access ports 173 provided in outer cylinder wall 140. Each access port 173 is internally threaded to receive an externally threaded plug 175 which seals the access port 173 and also supports one end of a guide rod 243 disposed within a biasing spring 242, hereinafter described. Each port 172 extends outwardly from the curved surface 150 of inner wall 142 and entirely through the latter wall. As FIG. 16 shows, port 172 houses a poppet valve assembly 174 including a ball cage 238 having an inner cylindrical portion 230 intersecting curved wall surface 150, an outwardly diverging conical valve seat section 232 connected to the inner cylindrical portion 230, and a cylindrical portion 234 connected to the conical section 232.

In the embodiment of the invention shown in FIGS. 5 and 16, each poppet valve assembly 174 comprises a spherical ball valve 236 engageable with the valve seat 232 in its associated hollow ball cage 238 in which ball valve 236 is movably supported and which carries a body member 239 and a coiled compression type ball-biasing spring 240 which urges the ball against the valve seat, and a large coiled compression type biasing spring 242. Biasing spring 242, in which spring guide rod 243 is located, is disposed between its associated access plug 175 and the body member 239 in its associated ball cage 238 and operates to hold the ball cage in place by means of a shoulder 244 in the ball cage which engages the edge of port 172. Guide rod 243 terminates about ½ inch from body member 239 and serves to prevent cage 238 from becoming dislodged if liquid slugging occurs. Body member 239 has a threaded hole 300 at its upper end to receive the threaded end of extraction tool 243A (shown in FIG. 17) which is used during assembly and disassembly of the poppet valve assembly 174 and others hereinafter described. In operation, compressed gas moving ahead of rolling piston 93 reaches a pressure level as the piston approaches the valve assemblies 174 whereby the rows of ball valves 236 pop open in sequence (i.e., row by row) in response to gas pressure and compressed gas is expelled from the cylinder 44A. As FIG. 16 makes clear, port 172, ball cage 238 and ball 236 are so designed and sized that only a minimum amount of waste space such as at 246 and 247 exists thereat when rotor 93 rolls therepast and, therefore, only a minimum amount of compressed unexpelled gas can accumulate therein after ball valve 236 resets against valve seat 232 as the rotor 93 rolls therepast.

Figure 17:
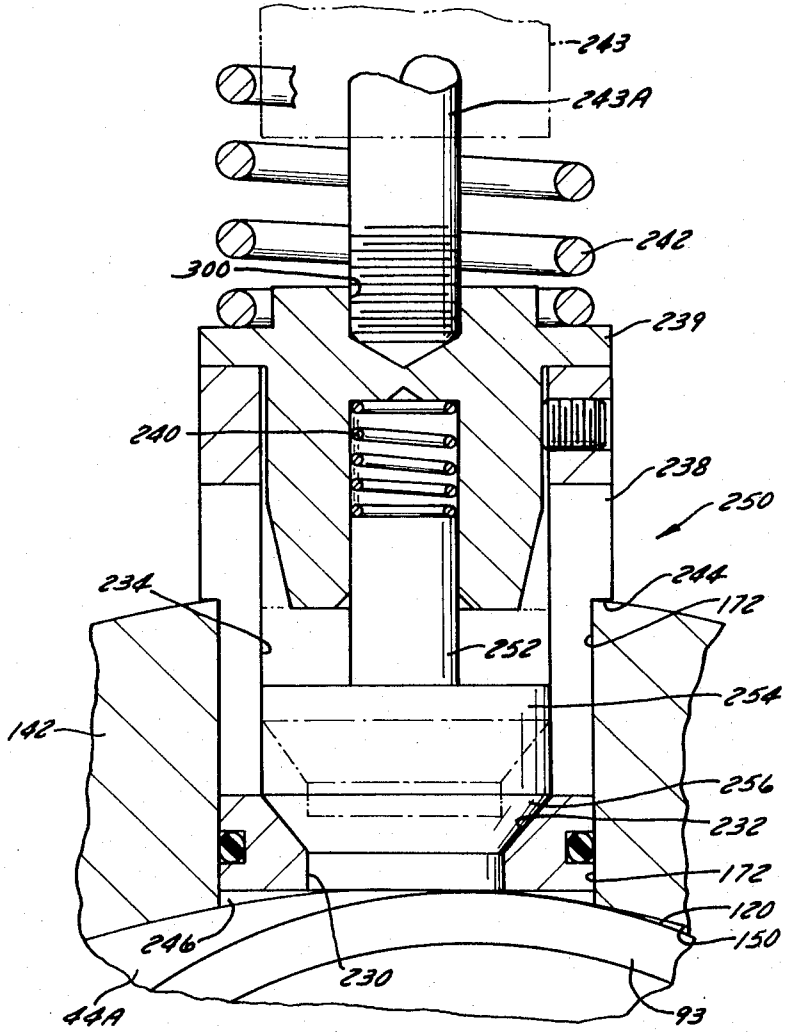
FIG. 17 is a view similar to FIG. 15 of another embodiment of a discharge valve.

If preferred, and as shown in FIG. 17, instead of a poppet valve assembly 174, another type of poppet valve assembly 250 may be used instead. Instead of a ball valve 236, assembly 250 employs a valve member 252 which includes a cylindrical body portion 254 which terminates in a conical portion 256 which mates with the conical valve seat section 232 of the cage 238 in discharge port 172. One advantage of valve member 252 over ball valve 236 is that, whereas the ball valve 236 may gradually acquire wear grooves thereon which result in gas leakage past the ball as the ball rotates and repositions itself from time-to-time on the valve seat 232, such repositioning which would result in leakage does not occur with valve member 252 seated against conical valve seat 232.

Figure 18:
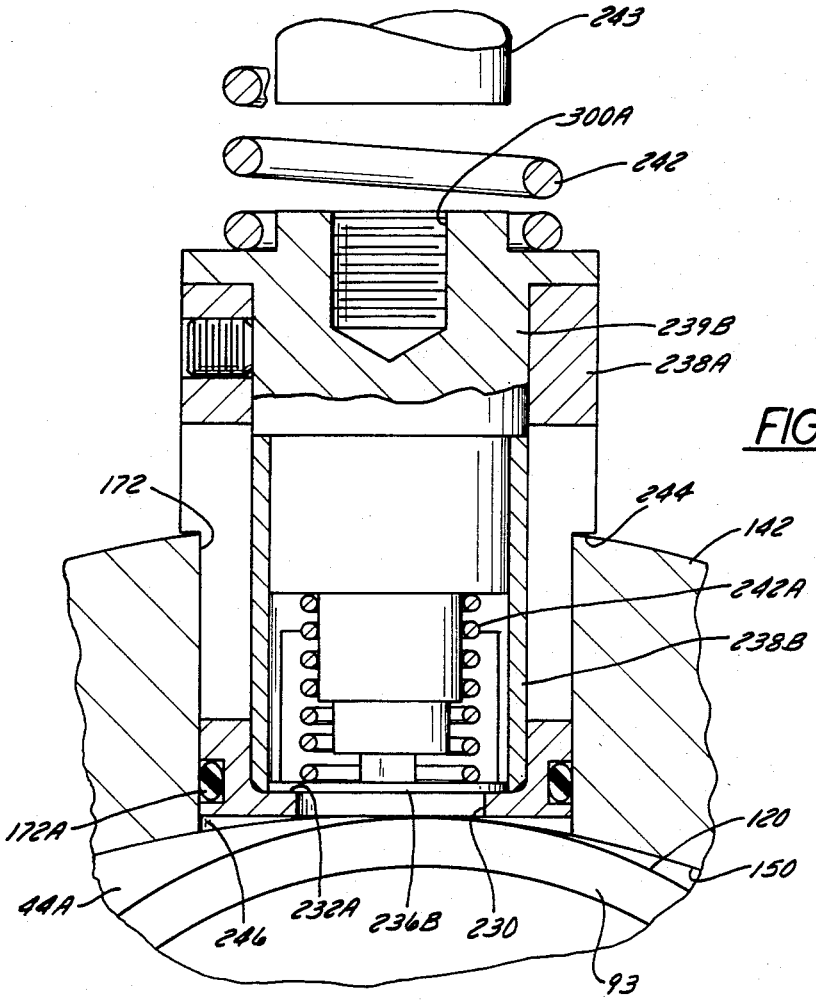
FIG. 18 is a view similar to FIG. 15 of still another embodiment of a discharge valve.

If preferred, and as shown in FIG. 18, instead of the poppet valve assemblies 174 or 250, still another type of poppet valve assembly 290 may be used. Instead of a ball valve 236 or valve member 252, assembly 290 employs a valve member 236B which takes the form of a disc which seats against a valve seat section 232A of a cage 238A which is located in discharge port 172 and provided with an O-ring seal 172A. Disc 236B is slidably mounted within a hollow cylindrical guide sleeve 238B in cage 238A. A body member 239B is secured within cage 238A by a set screw and holds guide sleeve 238B and a disc-biasing spring 242A in place. Body member 239B includes a threaded extraction tool-receiving hole 300A.

In some cases liquids such as lubricating oil or liquified gas may build up inside the cylinder chambers 44A–44D but the construction of the poppet valve assemblies, 174, 250 and 290 as disclosed herein enable the poppet valves 236, 256 and 296 to open against their biasing springs 242 and guide rods 243 to relieve the pressure in the cylinder chamber and thereby prevent damage to the compressor 10. Such liquid build-up is commonly referred to as "liquid slugging" in the compressor art.

As hereinbefore stated, compressor 10 is usable, for example, in any one of the four refrigeration systems shown in FIGS. 19, 20, 21 and 22. In each of those four systems, compressed gas from discharge port 18 of compressor 10 is delivered through an oil separator 29 to a condensor 31 wherein it condenses into a liquid and, after passing therefrom through a receiver 35 and an expansion valve 33 into an evaporator 37 wherein it expands to effect cooling, it is supplied to suction port 16 of compressor 10 for recompression.

In each of the four systems, provision is made to supply pressurized gas through supply line 204 and the passages 202 to the top ends of the vanes 160 to bias the vanes against their associated rotor pistons. This is in addition to the biasing springs which compensate for the pressure drop or differential between the top and bottom ends of the vanes. However, it is undesirable to inject extremely hot pressured gas to the top end of the vanes because this would reduce efficiency and also result in undue heating and too low a viscosity for the lubricating oil supplied to the vanes. Therefore, it is necessary to cool the gas to a temperature of about 95° F., for example, before it enters the passages 202 and this is done in either of two ways, first, by directing the gas from discharge chamber 170 through a line 183 and through a desuperheater 185 (shown in FIGS. 20 and 22) before supplying it to line 204 and the passages 202 or, second, by directing gas from the receiver 35 through a line 187 (shown in FIGS. 19 and 21) before supplying it to line 204 and the passages 202. In each of the two systems shown in FIGS. 19 and 20, there is a low pressure equalizing connection in the form of a gas line 181 connected between suction chamber 166 and oil reservoir or chamber 180 whereby equal and relatively low gas pressure conditions are maintained in both chambers, whereas relatively high gas pressure conditions are maintained in discharge chamber 170. In each of the two systems shown in FIGS. 21 and 22, there is a high pressure equalizing connection in the form of a gas line 187 connected between line 204 and oil reservoir or chamber 180 whereby a relatively high gas pressure condition is maintained in chamber 180. One advantage of the latter arrangement is that some oil which otherwise tends to drain into chamber 180 is forced back into the components which it lubricates and which are directly associated with chamber 180. In the systems shown in FIGS. 19 and 21, the condenser 31 performs the oil-cooling function performed by the desuperheater 185 in the systems shown in FIGS. 20 and 22. It is to be understood that, for purposes of this description and not by way of limitation, the relatively high gas pressure conditions in discharge chamber 170 (in FIGS. 19, 20, 21, 22) and in oil reservoir or chamber 180 (in FIGS. 21 and 22) are on the order of about 135 to 200 p.s.i.

In an actual embodiment of a four-cylinder compressor 10 in accordance with the invention which was designed, built and tested by applicant, the compressor 10 was about three feet long and about one foot in diameter in outside dimension. However, a compressor in accordance with the invention could be of some other size. The rotor assembly shaft 92 was connected to be driven by electric motor 20 directly or by belt drive and was driven at speeds in the range of 900 to 1800 R.P.M. The compressor is able to displace about 400 cubic feet of gas per minute at certain speeds, for example. The suction pressure at the suction chamber port 16 ranged from atmospheric pressure to about 40 p.s.i. The discharge pressure at the discharge chamber port 18 ranged from about 135 p.s.i. to 185 p.s.i. The length of travel of each vane 160 between extreme upper and lower positions was on the order of $1\frac{1}{8}$ inches and the vane travelled at an average velocity of only about 350 feet per minute.

In the embodiment disclosed herein the compressor 10 comprises four cylinders and the two center roller pistons are displaced 180° from the two extreme end roller pistons so as to provide balance and reduce vibrations, while at the same time eliminating the need for any special counterweights attached to the rotor or special balancing procedures. Preferably a larger compressor constructed from the modular components employed in compressor 10 would be built in multiples of four cylinders (and associated components) to preserve the balance.

We claim:

1. A rotary gas compressor comprising:

a housing assembly adapted to be horizontally disposed during operation and a cylinder housing having an outer cylinder wall and a concentric inner cylinder wall defining a cylinder chamber, a vane slot communicating with said cylinder chamber through said inner cylinder wall, a reciprocably movable vane mounted in said vane slot, means for biasing said vane toward said cylinder chamber, a suction chamber communicating with said cylinder chamber through a suction port in said inner cylinder wall on one side of said vane slot, a discharge chamber communicating with said cylinder chamber through a plurality of circumferentially spaced apart discharge ports in said inner cylinder wall on the other side of said vane slot, a plurality of independently operable discharge valve assemblies, one valve assembly for each of said discharge ports;

and a rotor assembly comprising a rotatable shaft mounted on said housing assembly, an eccentric crank arm on said shaft and located in said cylinder chamber, and a roller piston rotatably mounted on said crankarm and engaged with said cylinder wall and with said vane;

each discharge valve assembly including a cage having an opening located near the surface of said inner cylinder wall engaged by said roller piston and a valve seat surrounding said opening;

each discharge assembly valve further including a movable valve member movably mounted in said cage and seatable against said valve seat;

each discharge valve assembly also including biasing means to bias said valve member toward seated position;

said discharge valve assembly being constructed so as to reduce the colume of any waste space in the associated discharge port between said roller piston moving therepast and said cage and the valve member therein when the latter is in seated position.

2. A compressor according to claim 1 wherein said movable valve member is spherical.

3. A compressor according to claim 1 wherein said movable valve member comprises a conical portion for engagement with said valve seat.

4. A compressor according to claim 2 or 3 wherein said valve seat portion is conical.

5. A compressor according to claim 1 wherein said movable valve member is a disc.

6. A compressor according to claim 1 wherein said biasing means includes a first spring mounted on said cage and bearing against said movable valve member and a second spring bearing against said cage to maintain the latter in proper position relative to said discharge port.

7. A rotary gas compressor comprising:

a housing assembly comprising a cylinder wall defining a cylinder chamber, a vane slot communicating with said cylinder chamber, said vane slot having a pair of spaced side walls, a pair of spaced apart end walls, and a top wall, a reciprocably movable vane mounted in said vane slot, said vane having a pair of spaced apart side surfaces, a pair of spaced apart end surfaces, a top surface, and a bottom surface, said vane having a plurality of grooves extending around the periphery thereof, each groove traversing said pair of side surfaces and said pair of end surfaces, and wherein said vane includes at least one other groove interconnecting said plurality of grooves, an oil flow passage communicating with said vane slot, a suction chamber communicating with said cylinder through a suction port, a discharge chamber communicating with said cylinder chamber through a discharge port, a discharge valve for said discharge port, an oil sump chamber;

a rotor assembly comprising a rotatable shaft mounted on said housing assembly, an eccentric crank arm on said shaft and located in said cylinder chamber, and a roller piston rotatably mounted on said crankarm and engaged with said cylinder wall and with said vane;

and a pump on said housing assembly driven by said rotatable shaft for supplying oil from said oil sump chamber through said oil flow passage to said vane slot and to said grooves in said vane.

8. A compressor according to claim 7 wherein said vane has at least one recess therewithin to reduce the mass of said vane.

9. A compressor according to claim 8 wherein said recess extends inwardly from said top surface of said vane.

* * * * *